US006029279A

United States Patent [19]

Ralston et al.

[11] Patent Number: 6,029,279

[45] **Date of Patent: *Feb. 29, 2000**

[54] PLEATING CHEERLEADER SKIRT

[75] Inventors: Sherise Ralston; Michele Wolken, both of Richardson, Tex.

[73] Assignee: NSG Corporation, Garland, Tex.

[ * ] Notice: This patent is subject to a terminal disclaimer.

[21] Appl. No.: 09/106,829

[22] Filed: Jun. 29, 1998

Related U.S. Application Data

[63] Continuation of application No. 08/846,626, Apr. 30, 1997, Pat. No. 5,771,494.

[51] Int. Cl.[7] ..... A41D 1/14

[52] U.S. Cl. ..... 2/211; 2/74; 2/DIG. 2

[58] Field of Search ..... 2/211–213, 74, 2/75, 67, 105, 226, 272, 48, 243.1, DIG. 1, DIG. 4, DIG. 2; D2/735, 736, 740, 741, 775, 776, 851, 852, 861

[56] References Cited

U.S. PATENT DOCUMENTS

| | | | |
|---|---|---|---|
| 988,350 | 4/1911 | Kelsey | 2/211 |
| 1,076,124 | 10/1913 | Juda | 2/211 |
| 2,791,779 | 5/1957 | Presson | 2/211 |
| 5,327,586 | 7/1994 | Evans et al. | 2/211 |
| 5,566,393 | 10/1996 | Best | 2/211 X |
| 5,771,494 | 6/1998 | Ralston et al. | 2/211 |

*Primary Examiner*—Gloria Hale
*Attorney, Agent, or Firm*—Locke Liddell & Sapp LLP

[57] ABSTRACT

A pleated skirt suitable for cheerleading is disclosed which provides for active movement of the wearer, and desirable movement and visual effects of the skirt during wearing. Preferably, the skirt is constructed of a skirt body and at least two panels which are each attached only partially along their length to adjoining panels. The sections of the panels which are nonattached result in overlapping pleated flaps. Different colors can be used for each side of the overlapping pleated flaps and the alternate color is partially visible when the skirt is worn for increased visual variety.

18 Claims, 3 Drawing Sheets

PLEATING CHEERLEADER SKIRT

RELATED APPLICATIONS

This application is a continuation of application Ser. No. 08/846,626 filed Apr. 30, 1997, entitled "Pleated Cheerleading Skirt" which issued Jun. 30, 1998 as U.S. Pat. No. 5,771,494.

BACKGROUND OF THE INVENTION

1. Field of the Invention

This invention relates to the field of wearing apparel and more particularly to apparel for cheerleaders.

2. Description of Related Information

Cheerleading has been a popular pursuit among students in grade schools, middle schools, and colleges for many years. In recent years, professional cheerleaders have been performing at football, basketball and other professional sporting events. Traditionally, cheerleaders have worn shortened versions of street clothing made in school or team colors. Female cheerleader uniforms, especially at the school level, often include a pleated skirt which is a shortened version of a classic pleated skirt such as might be found in collections of street clothing for women and girls. Such skirts are made of a layer of material, one side meant to be exposed and one side meant to be concealed next to the wearer's body. The concealed side contains the raw edges and seams which are generally unattractive in appearance.

The modern cheerleader is most often an athlete, a dancer, and a gymnast required to perform complex choreographed routines. The gymnastics and tumbling movements as well as the funk, jazz and other dance steps used by the cheerleader have led to requirements for apparel which will permit the desired movements. In addition, it is sometimes desirable to have the apparel of the cheerleader enhance the visual effect of the movements.

As a further consideration, there is also a need for school-aged cheerleaders in particular to maximize the investment made in cheerleading apparel. Cheerleaders often have to pay for their own uniforms and, since schools typically use one color for "home" games and the other for "away" games, multiple uniforms may be required which are identical except for the color.

Despite the introduction of shorts, leggings and other alternative types of clothing into the cheerleader's costume choices to permit the enhanced movements and visual effects, there is also a desire to maintain the traditional, classic look of the cheerleader wearing a pleated, short skirt for certain routines or portions of routines. Since, as stated above, the concealed side of the traditional pleated skirt is unattractive, it is undesirable for a cheerleader wearing such a skirt to employ moves in her routine which would tend to cause the skirt to fly up or flip outward. Further, the construction of such skirts may make such moves as splits and kicks restricted or impossible to include in the routine.

A new skirt is herein disclosed which solves the problems discussed above. The skirt is pleated so that there are no unfinished seams and edges to be exposed during the routines. The skirt is constructed with a plurality of panels which are connected to adjoining panels only a partial distance from the top of the skirt, thus providing for increased mobility of the wearer in cheerleading routines. Also, one side of the panels of the skirt is preferably made in an alternate color so that the design of the skirt also contributes to the visual effect of the cheerleader routine.

In the embodiment where an alternative color is employed on one side, the audience is able to view two or more team colors during the routine as movements are employed by the wearer. The skirt also presents the appearance of the classic pleated cheerleading skirt while the wearer is in a rest standing position.

SUMMARY OF THE INVENTION

The pleated cheerleading skirt of the present invention overcomes the above-mentioned disadvantages and drawbacks which are characteristic of the prior art.

In accordance with the present invention, a pleated cheerleading skirt is disclosed which comprises a waistband, and a plurality of pleated panels extending downwardly from the waistband. The panels are attached to adjacent panels for only part of their length. The sections of the panels which are nonattached result in overlapping pleated flaps.

In a preferred embodiment, the skirt is constructed with one color on the outer side of the overlapping pleated flaps and a contrasting color on the inner side. The skirt may include one or more contrasting colors on the inner sides of the pleated flaps.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

DESCRIPTION OF THE PREFERRED EMBODIMENTS

Figure 2:
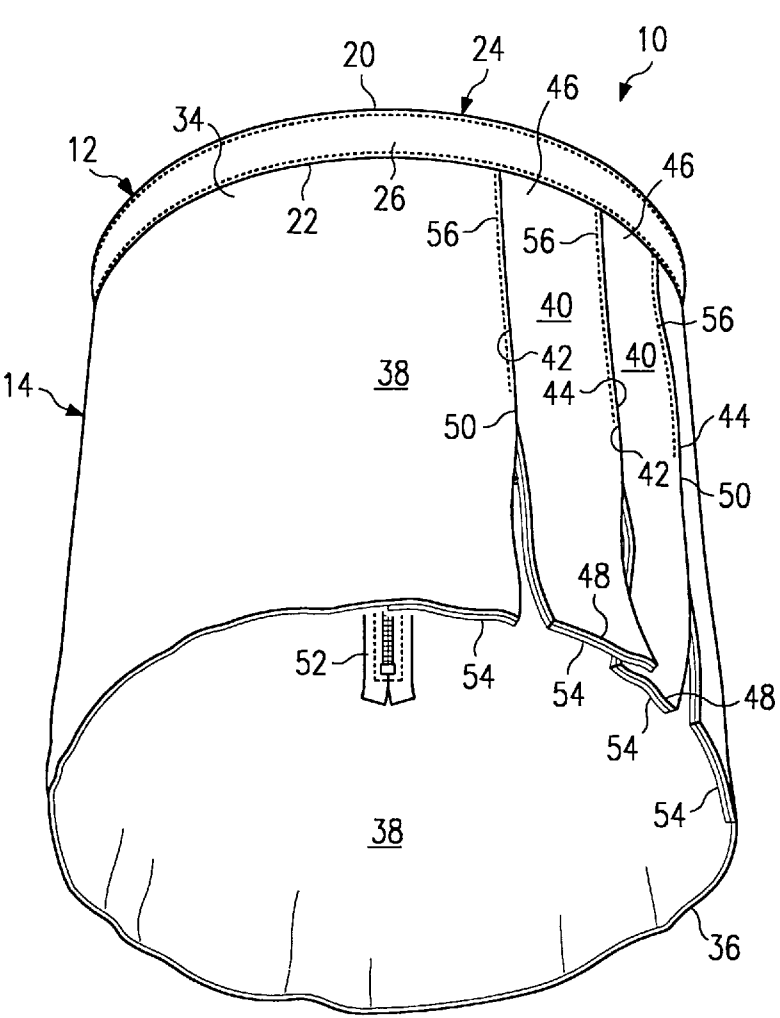
FIG. 2 shows a perspective view of the skirt of FIG. 1 from the hem area, showing partial views of the front and back sides of the skirt.

The cheerleading skirt of the present invention is preferably constructed of sturdy, washable material suitable for use in outdoor sporting settings, however any material which can be constructed into the desired shape may be used. Preferably, a polyester, wool, or blend thereof is employed.

A preferred method of securing or attaching the parts of the skirt together is by sewing or stitching. Those of ordinary skill in the art will recognize that other methods can be used to secure or attach the parts of the skirt such as the application of adhesives.

The panels that are incorporated in the cheerleading skirt of the present invention can be made of a suitable size and width by measuring the wearer or by using standard measurements in the art for misses, juniors or children's sizes. The width of the panels is preferably from about 2" to about 8" (finished) at the hem, most preferably about 3.25" to about 5". The unfinished panels prior to joining are from about 2.4" to about 8.4" and preferably about 3.9" to about 5.4". The width of the panels at the waist is preferably from about 1" to about 3.5" (finished), 1.5" to 4" (unfinished) and most preferably 1.5" to 1.25" (finished) and 2" to 2.75" (unfinished). It is desirable that the panel flare out and thus be made wider at the hem edge. The number of panels needed will depend on the size of the proposed wearer, the desired visual effect of the skirt in motion, and the desired width of the panels.

According to a preferred embodiment of the present invention, the skirt includes a skirt body attached to a waistband and at least two skirt panels attached to the waistband between the ends of the skirt body. The skirt panels are disposed adjacent to each other along the long edges thereof and along the long edges of the ends of the skirt body. The number of panels used can be altered to alter the visual effect and movement of the skirt. For instance, in another preferred embodiment of the present invention, five skirt panels are attached to the waistband of the skirt between the ends of the skirt body. Specifically, two side skirt panels are attached to the waistband of the skirt at each end of the skirt body and a front skirt panel is attached to the waistband of the skirt between the two sets of side skirt panels. Preferably the front skirt panel is wider than the side skirt panels. According to this embodiment of the present invention, the side skirt panels are disposed adjacent to each other along the long edges thereof and along the long edges of the ends of the skirt body. Similarly, the front skirt panel is disposed adjacent to and along the long edges of the side skirt panels.

A closure device is preferably inserted into the skirt body. The closure device is preferably a zipper. Those of ordinary skill in the art will recognize that other closure devices such as buttons, hook and loop fasteners, snaps and other closures common in the clothing art may be used with minor modifications such as are well known in the art. In an alternate embodiment, an elastic waistband is employed which permits the wearer to utilize the garment by stretching the waistband over the hips and allowing it to retract on the waistline of the wearer.

A waistband assembly is made from at least two substantially rectangular strips. The strips are attached so that the inner sides of the strips are disposed in a facing relationship to each other in the final assembly. The waistband assembly may be the same length as or longer than the top of the composite skirt assembly which includes the skirt body and skirt panels. In a preferred embodiment, the waistband assembly is longer than the top of the composite skirt assembly, forming a flap portion unattached to the top of the composite skirt assembly. The flap portion is desirable because it allows for a neat, tailored appearance which will not become easily unsecured during movement. For example, a button can be positioned near the area where the skirt is attached to the waistband and a buttonhole can be placed on the other end of the waistband. The flap attractively tucks under the opposite end when the skirt is buttoned providing a tailored finished appearance and making it more difficult for the button to come out of the buttonhole. The material of the waistband can match or contrast with the skirt.

Figure 1:
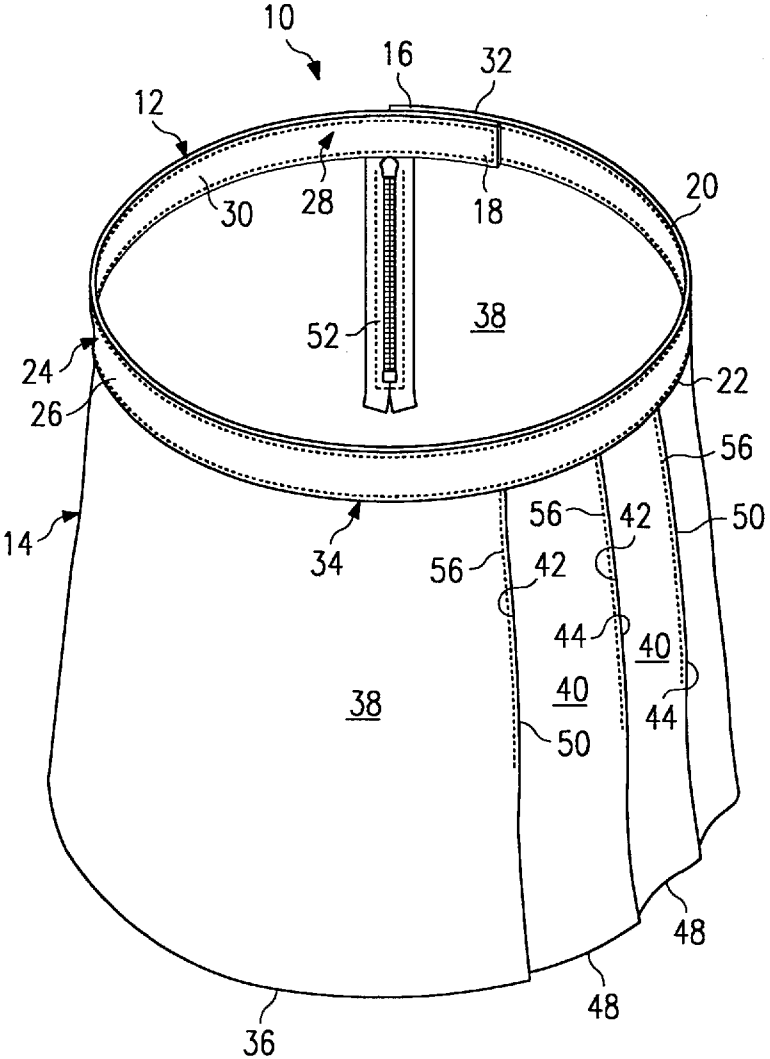
FIG. 1 shows a perspective view of an embodiment of the cheerleading skirt of the present invention constructed with two panels on one side thereof with a zipper closure in the back and depicting the inside and outside of the skirt.

Referring now to the drawings, and in particular to FIGS. 1 and 2, a preferred embodiment of the cheerleading skirt of the present invention is shown and generally designated by the reference numeral 10. The cheerleading skirt 10 of the present invention is broadly comprised of a waistband assembly 12 and a composite skirt assembly 14. The waistband has two ends 16 and 18, a top edge 20, and a bottom edge 22. The waistband assembly 12 is made up of a first waistband component 24 having an outer surface 26 and an inner surface (not shown), and a second waistband component 28 having an outer surface 30 and an inner surface (not shown). The waistband components 24 and 28 are attached so that their inner surfaces are adjacent to and facing each other. In a preferred embodiment and as shown in FIGS. 1 and 2, the waistband assembly 12 is longer than the top edge of the composite skirt assembly 14 forming a flap portion 32 which is unattached to the composite skirt assembly 14. A button (not shown) is secured to the outer side 26 of the waistband assembly 12 and a buttonhole (not shown) is provided in the flap portion 32 which can be attached to the button (not shown).

The composite skirt assembly 14 has a top edge 34 and a hem edge 36. The top edge 34 is attached to the bottom edge 22 of the waistband. The composite skirt assembly 14 includes a skirt body 38 and a plurality of skirt panels 40. Each of the skirt panels 40 has a first long edge 42 and a second long edge 44, a top edge 46 and a hem edge 48. The long edges 42 and 44 of the panels 40 are attached to the long edges 42 and 44 of adjacent panels 40 and to adjacent long edges 50 of the skirt body 38 to form an attachment seam 56 which extends partially down the long edges 42, 44 and 50, preferably about one third to one half the length of the long edges 42, 44 and 50.

A closure apparatus, such as zipper 52 is shown as being attached to the skirt body 38 at the back of the skirt 10. The zipper 52 is attached to the skirt body 38 according to techniques well known to those of ordinary skill in the art. Those of ordinary skill in the art will also recognize that closure apparatus other than zipper 52 may be substituted for the zipper 52.

As best seen in FIG. 2, the skirt panels 40 and the portions of the skirt body 38 adjacent the skirt panels 40 include a layer of backing material 54. The backing material 54, preferably is formed of a different color material than the skirt body 38 and the skirt panels 40 so as to provide a contrasting color scheme when in use as noted above.

Figure 4:
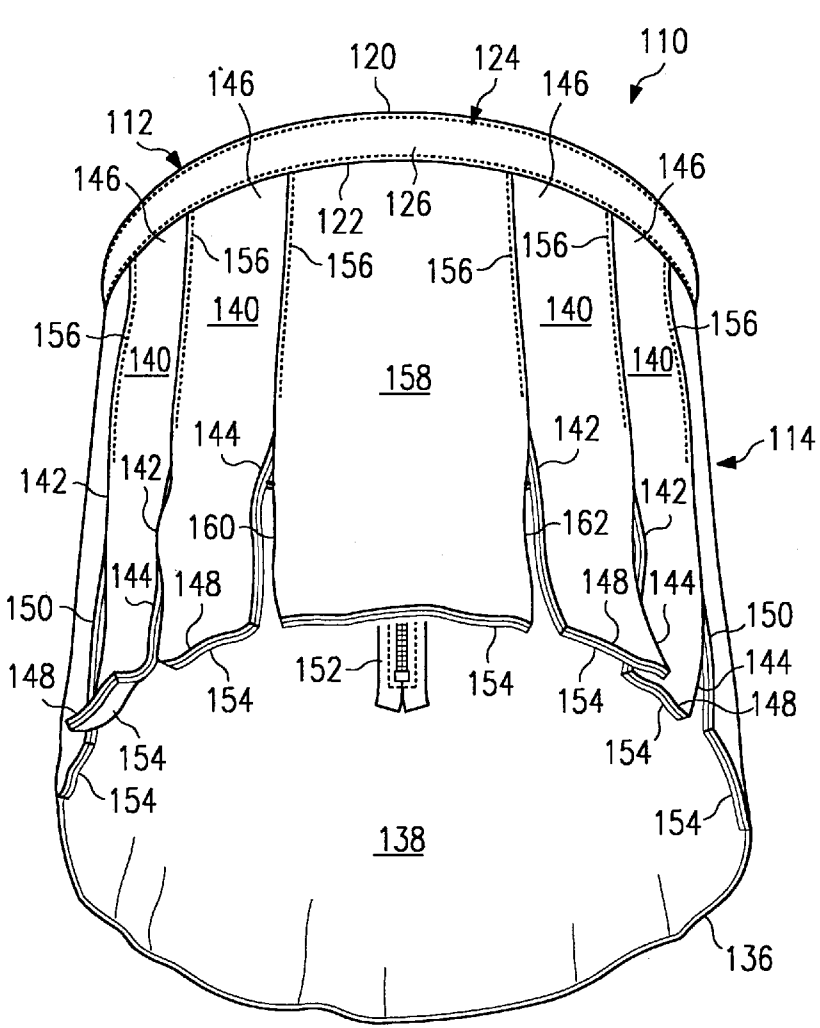
FIG. 4 shows a perspective view of the skirt of FIG. 3 from the hem area, showing partial views of the front and back sides of the skirt.
Figure 3:
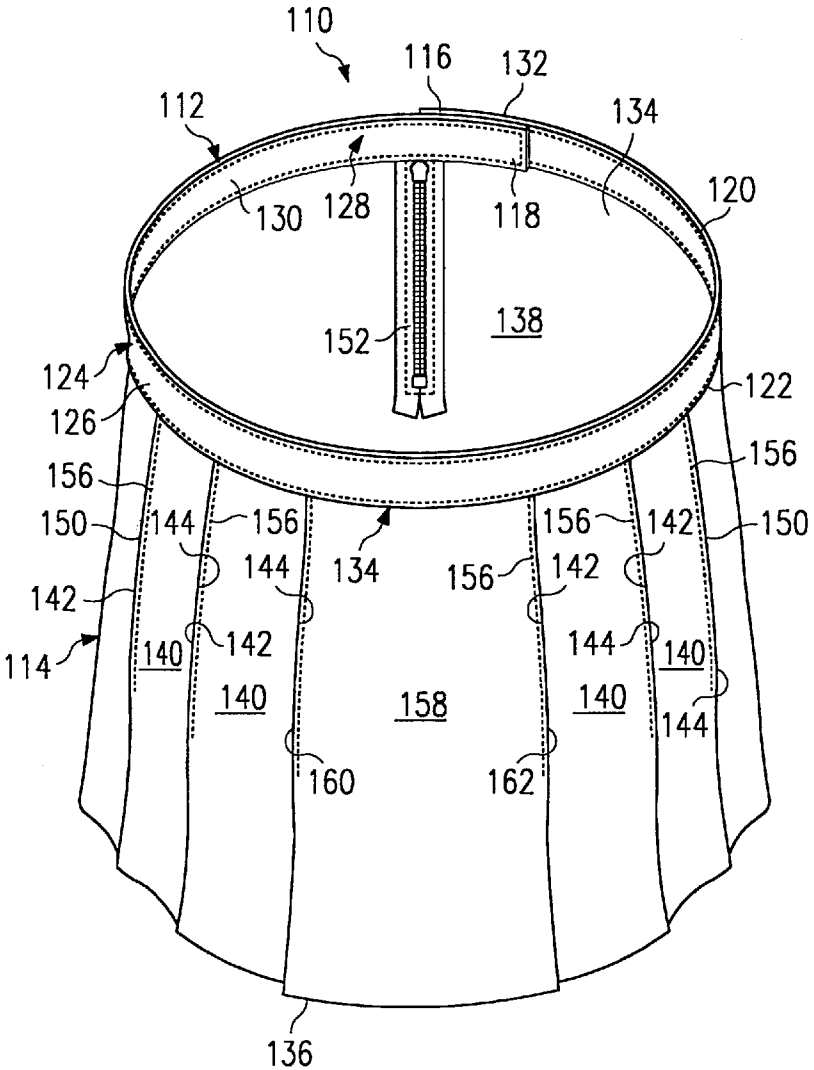
FIG. 3 shows a perspective view of a second embodiment of the cheerleading skirt of the present invention constructed with five panels on the front thereof with a zipper closure in the back and depicting the inside and outside of the skirt.

Another preferred embodiment of the cheerleading skirt of the present invention is shown in FIGS. 3 and 4 and is generally designated by the reference numeral 110. The cheerleading skirt 110 of the present invention is broadly comprised of a waistband assembly 112 and a composite skirt assembly 114. The waistband has two ends 116 and 118, a top edge 120 and a bottom edge 122. The waistband assembly 112 is made up of a first waistband component 124 having an outer surface 126 and an inner surface (not shown), and a second waistband component 128 having an outer surface 130 and an inner surface (not shown). The waistband components 124 and 128 are attached so that their inner surfaces are adjacent to and facing each other.

In a preferred embodiment and as shown in FIGS. 3 and 4, the waistband assembly 112 is longer than the top edge of the composite skirt assembly 114 forming a flap portion 132 which is unattached to the composite skirt assembly 114. A button (not shown) is secured to the outer side 126 of the waistband assembly 112 and a buttonhole (not shown) is provided in the flap portion 132 which can be attached to the button (not shown).

The composite skirt assembly 114 has a top edge 134 and a hem edge 136. The top edge 134 is attached to the bottom edge 122 of the waistband. The composite skirt assembly 114 includes a skirt body 138, a plurality of side panels 140 and a front panel 158. Preferably, the front skirt panel 158 is wider than the side skirt panels 140 as shown in FIGS. 3 and 4. Each of the side skirt panels 140 have a first long edge 142 and a second long edge 144, a top edge 146 and a hem edge 148. The front skirt panel 158 has a first long edge 160 and a second long edge 162. The long edges 142 and 144 of the side skirt panels 140 are attached to the long edges 142 and 144 of adjacent side skirt panels 140, to adjacent long edges 160 and 162 of the front skirt panel 158 and to adjacent long edges 150 of the skirt body 138 to form an attachment seam 156 which extends partially down the long edges 142, 144, 150, 160 and 162 preferably about one third to one half the length of the long edges 142, 144, 150, 160 and 162.

A closure apparatus, such as zipper 152 is shown as being attached to the skirt body 138 at the back of the skirt 110. The zipper 152 is attached to the skirt body 138 according to techniques well known to those of ordinary skill in the art. Those of ordinary skill in the art will also recognize that closure apparatus other than zipper 152 may be substituted for the zipper 152.

As best seen in FIG. 2, the side skirt panels 140, the front skirt panel 158 and the portions of the skirt body 138 adjacent the side skirt panels 140 include a layer of backing material 154. The backing material 154, preferably is formed of a different color material than the skirt body 138, the side skirt panels 140 and the front skirt panel 158 so as to provide a contrasting color scheme when in use as noted above.

Figure 5:
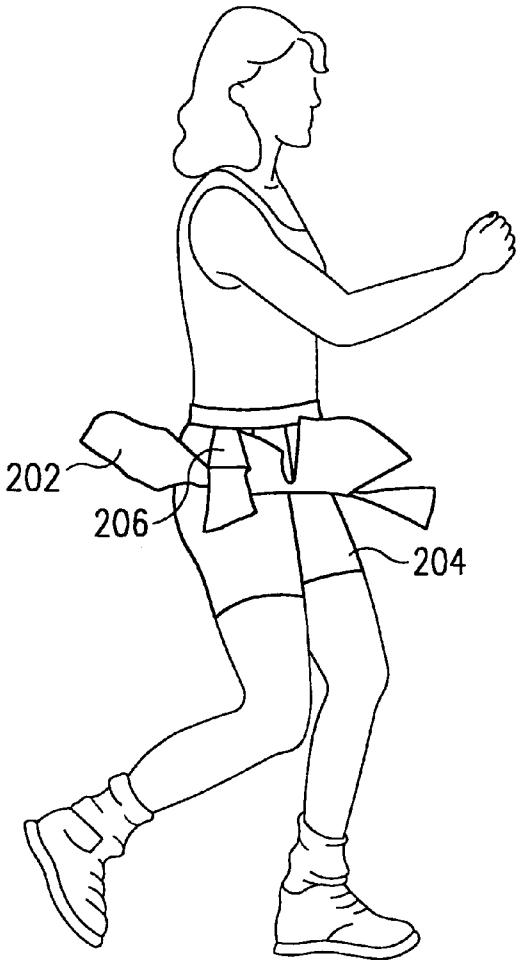
FIG. 5 shows an embodiment of the cheerleading skirt of the present invention on a wearer in motion.

FIG. 5 shows an embodiment of the cheerleading skirt of the present invention on a wearer. In response to certain movements of the wearer, the reverse side 202 of the skirt is exposed. The wearer is shown wearing pants 204, which are not a part of the skirt but a separate garment. During exposure of the skirt's reverse side 202, the outer side of the skirt 206 is also visible. In a preferred embodiment of FIG. 5, the reverse side 202 of the skirt is in a contrasting color to the outer side of the skirt 206, providing for visual diversity during the routine.

Figure 6:
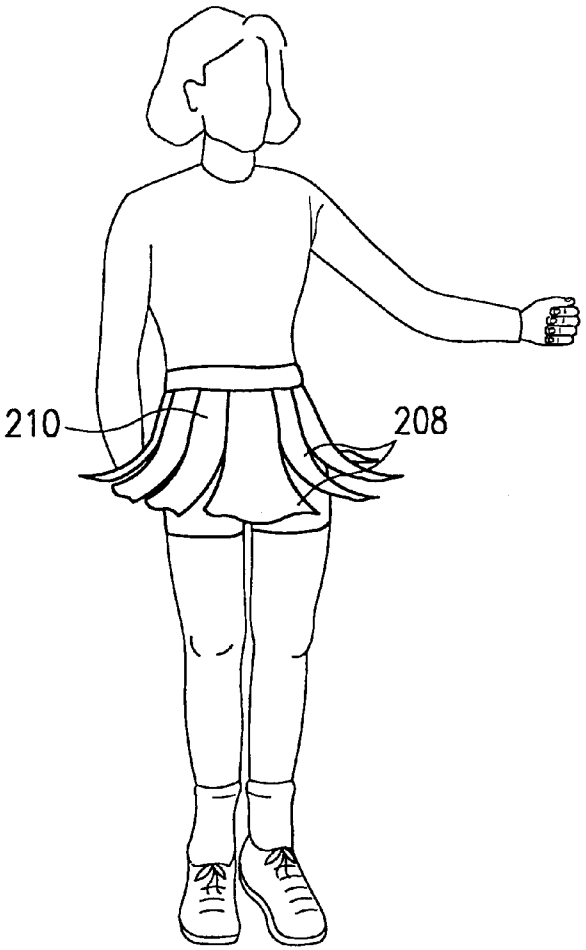
FIG. 6 shows an embodiment of the cheerleading skirt of the present invention on a wearer in the process of completing motion which has resulted in the depicted movement of the cheerleading skirt.

FIG. 6 shows an embodiment of the skirt of the present invention on a wearer in action. In response to certain movements such as a "basketball toss," during which the wearer is tossed straight up in the air and is then caught, the skirt panels 208 fly away from one another to create the unique effect illustrated. The outer side of the skirt 210 remains visible while the underside of the skirt (not visible) may be exposed. In a preferred embodiment of FIG. 6, the outer side and underside of the skirt are of contrasting colors.

While preferred embodiments of the invention have been shown and described, it will be understood by persons skilled in the art that various changes and modifications may be made without departing from the spirit and scope of the invention which is defined by the following claims.

We claim:

1. A skirt suitable for cheerleading and other active sports, comprising:

a waistband assembly;

a composite skirt assembly having a top edge and a hem edge, the top edge attached to the waistband assembly;

the composite skirt assembly formed by a plurality of skirt panels each having a first and second long edge, wherein each of said first long edges is attached to one of the second long edges of another skirt panel forming an attachment seam, each of the attachment seams extending only partially along the length of respective long edges, and wherein one of the attachment seams is a closure seam;

a closure apparatus between the first long edge and the second long edge of the skirt panels forming the closure seam; and wherein a said first long edge of a skirt panel overlaps a first long edge of an adjacent skirt panel.

2. The skirt of claim 1 wherein each skirt panel includes an outer side and an inner side, wherein the inner side of each skirt panel is a different color from the outer side of the skirt panel.

3. The skirt of claim 1 wherein the waistband assembly has a first end and a second end, the first end and the second end including complimentary portions of an attachment mechanism such that the first and second ends can be attached using the attachment mechanism, and wherein the first and second ends of the waistband assembly meet along the closure seam of the skirt panels.

4. The skirt of claim 1 wherein the closure apparatus is a zipper.

5. The skirt of claim 1 wherein the composite skirt assembly is formed by eight skirt panels.

6. The skirt of claim 1 wherein the composite skirt assembly is formed by twelve skirt panels.

7. The skirt of claim 1 wherein the attachment seams are formed by slightly overlapping each first long edge of each skirt panel over the corresponding second long edge of the adjacent skirt panel.

8. The skirt of claim 1 wherein the attachment seams are formed attaching each first long edge of each skirt panel directly to the corresponding second long edge of the adjacent skirt panel.

9. The skirt of claim 1 wherein the waistband assembly is longer than the top edge of the composite skirt assembly, forming a flap which is unattached to the composite skirt assembly.

10. A skirt suitable for cheerleading and other active sports, comprising:

a waistband assembly having a first end, a second end, a top edge and a bottom edge, the waistband assembly including an attachment mechanism attached to the first end and a receptor mechanism attached to the second end allowing the first and second ends to be attached together;

a composite skirt assembly having a top edge and a hem edge, the top edge attached to the waistband assembly, the composite skirt assembly formed by a plurality of skirt panels;

each skirt panel having a first and second long edge, a top edge, a hem edge and a backing material layer, wherein each of said first long edges is attached to one of the second long edges of another skirt panel forming an attachment seam, each of the attachment seams extending only partially along the length of respective long edges, and wherein one of the attachment seams is a closure seam;

a closure apparatus between the first long edge and the second long edge of the skirt panels forming the closure seam;

wherein a said first long edge of a skirt panel overlaps a first long edge of an adjacent skirt panel; and wherein a said second long edge of a second one of the skirt panels overlaps an adjacent second long edge of the skirt body.

11. The skirt of claim 10 wherein the backing material layer of each skirt panel is a different color from an outer side of the skirt panel.

12. The skirt of claim 10 wherein the closure apparatus is a zipper.

13. The skirt of claim 10 wherein the attachment mechanism is a button and the receptor mechanism is a button hole.

14. The skirt of claim 10 wherein the composite skirt assembly is formed by eight skirt panels.

15. The skirt of claim 10 wherein the composite skirt assembly is formed by twelve skirt panels.

16. The skirt of claim 10 wherein the attachment seams are formed by slightly overlapping each first long edge of each skirt panel over the corresponding second long edge of the adjacent skirt panel.

17. The skirt of claim 10 wherein the attachment seams are formed attaching each first long edge of each skirt panel directly to the corresponding second long edge of the adjacent skirt panel.

18. The skirt of claim 10 wherein the waistband assembly is longer than the top edge of the composite skirt assembly, forming a flap which is unattached to the composite skirt assembly.

* * * * *

UNITED STATES PATENT AND TRADEMARK OFFICE

CERTIFICATE OF CORRECTION

PATENT NO. : 6,029,279
DATED : February 29, 2000
INVENTOR(S) : Sherise Ralston, et. al.

It is certified that error appears in the above-indentified patent and that said Letters Patent is hereby corrected as shown below:

Title page, item [54] and col 1, should read -- Pleated Cheerleading Skirt--.

Signed and Sealed this

Twentieth Day of March, 2001

*Attest:*

NICHOLAS P. GODICI

*Attesting Officer*

*Acting Director of the United States Patent and Trademark Office*